United States Patent [19]

Suzuki et al.

[11] 4,380,261

[45] Apr. 19, 1983

[54] DIE-CASTING METHOD

[75] Inventors: Haruo Suzuki, Haruhimura; Shigeyoshi Hashimoto, Anjo, both of Japan

[73] Assignee: Nippondenso Co., Ltd., Kariya, Japan

[21] Appl. No.: 295,303

[22] Filed: Aug. 24, 1981

Related U.S. Application Data

[63] Continuation of Ser. No. 118,806, Feb. 14, 1979 as PCT/JP79/00035, published as W080/01658, 102(e) date Apr. 24, 1979, abandoned.

[51] Int. Cl.[3] ..... B22D 18/02

[52] U.S. Cl. ..... 164/120

[58] Field of Search ..... 164/113, 120, 312-320

[56] References Cited

U.S. PATENT DOCUMENTS 3,106,002 10/1963 Bauer ..... 164/120

FOREIGN PATENT DOCUMENTS 38-19559 9/1963 Japan .
48-7570 3/1973 Japan .
49-36093 9/1974 Japan .
50-130631 5/1975 Japan .
51-129817 11/1976 Japan .

OTHER PUBLICATIONS

Bryant, A. L., No. 65, SDCE, Acurad Casting of Hypereutectic Aluminum Engine Blocks (1970).
Lord, No. 84, SDCE, Application of Vaccum in Die Casting for Quality Improvement (1970).
Benedyk, No. 86, SDCE, Squeeze Casting (1970).
Mulholland, No. 1272, SDCE, Vertical Die Casting Machine (1970).
Bradley, No. G-T75-021, Acurad Process for Engine Blocks in 390 Aluminum (1975).
Davis et al., No. G-T77-011, The Influence of Injection Cycle on Casting Quality-Part I (1977).
Davis et al., No. G-t77-012, SDCE, The Influence of Injection Cycle on Casting Quality (1977).
Battiston, No. G-T79-045, Development of the Pore--Free Process for Hot Chamber Zinc Die Casting, SDCE (1979).
Fulda, No. G-T79-083, Impregnation of Die Cast Components with Anaerobic Sealants, SDCE (1979).

*Primary Examiner*—Kuang Y. Lin
*Attorney, Agent, or Firm*—Cushman, Darby & Cushman

[57] ABSTRACT

A die-casting method in which a molten metal is injected into a die cavity 30 through a runner 31 and the molten metal in the die cavity is pressurized and squeezed also through a squeeze passage 17 which is communicated with the die cavity 30 at a point other than the point of connection of the runner with the die cavity. The timing of commencement of the squeeze effected through the squeeze passage 17, squeezing pressure and the amount of molten metal squeezed out of the squeeze passage 17 into the die cavity 30 are suitably determined so that the formation of cavities or voids which adversely affect the strength and gas-tightness of die-cast product is remarkably decreased to assure a reliable manufacture of voidless die-cast products without substantial fluctuation of quality. The method of the invention can effectively be applied to the manufacture of die-cast products which are required to have high gas-tightness or intended for use under high pressure, and thus can be used to die-cast housings of compressors, pumps, etc.

13 Claims, 13 Drawing Figures

(a)

(b)

(a)

(b)

100μ

DIE-CASTING METHOD

RELATED APPLICATIONS

This is a continuation of Ser. No. 118,806, now abandoned, in which the PCT USA national formalities were completed Apr. 24, 1979, based on applicants' international application PCT/JP79/00035 filed Feb. 14, 1979.

TECHNICAL FIELD

The present invention relates to a die-casting method and, more particularly, to a die-casting method in which the molten metal is injected into a die cavity and is squeezed also at a portion of the die other than the portion through which the molten metal has been injected into the die cavity.

BACKGROUND ART

Japanese Patent Publication Nos. 48-7570 and 49-36093 disclose die-casting methods in which the molten metal is injected into a die cavity and is squeezed also at a portion of the mold cavity other than the portion through which the molten metal has been injected into the die cavity. In these known methods, however, the squeezing of the injected molten metal is effected only after the solidification of the metal in a restricted part of the injection passage or in the sprue through which the die cavity is communicated with the injection passage or runner. Therefore, it has been impossible to carry out a good die-casting operation with these known methods for the following reasons.

Namely, the restricted part of the injection passage or the sprue in the die-casting machine is liable to be more heated than other portions of the machine because of a high flow velocity of the molten metal through such portions of the machine. Therefore, if the restricted part or the sprue is positioned at the same level as the die cavity, the solidification of the metal in such a restricted part of sprue is delayed from the solidification of the metal in the die cavity. With the die-casting method in which the molten metal is squeezed after the metal is solidified in the sprue, the metal in the thin-walled parts of the die cavity will be solidified before the squeezing is commenced. It is, therefore, impossible to prevent cavities or voids from being formed in such thin-walled parts. If such cavities or voids are once formed, a considerably high pressure is required to squash and fill up the cavities or voids. With the prior art discussed above, therefore, it has been practically difficult to prevent the formation of cavities or voids. Further, since the squeezing is effected after the metal in the die cavity is partially solidified, various defects such as segregation, which would adversely affect the quality of the product, a surface fault like a sheared surface and so forth are inevitably caused.

In the past, it has also been proposed in Japanese Patent Laid-Open Publication No. 51-129817 to squeeze the molten metal immediately after the filling of the die cavity with the molten metal. This method, however, merely squeezes the molten metal without delay after the filling of the die cavity and does not suggest any consideration as to the level of the pressure to be applied and to the amount of molten metal forced by the pressure back into the die cavity (referred to hereunder as "squeezing displacement of metal"). According to the result of the studies made by the present inventors, it is impossible to effectively suppress the formation of cavities or voids and to avoid the fluctuation of quality of the products by simply squeezing the molten metal immediately after the filling of the die cavity with the metal.

Namely, it has been known by the inventors that, in this die-casting method, the squeezing pressure is directly transmitted also to the injection plunger because the squeeze is commenced while the metal in the sprue is still in the molten state. Thus, if the level of the squeezing pressure is considerably higher than the injection pressure, the injection plunger would be forced back by the pressure, so that the molten metal of an amount corresponding to the squeezing displacement of metal is moved back toward the injection side. It is, therefore, impossible to effect a substantial squeezing unless the squeezing displacement of metal is unduely increased. It has also been found that a sufficient squeezing cannot be achieved by a level of pressure as low as the level of the injection pressure imparted by the injection plunger. Thus, in order to surely prevent generation of cavities or voids, it is essential to maintain the squeezing pressure at a proper level.

As to the amount of the squeezing displacement of metal, a displacement which is too small would not be able to satisfactorily squash and fill up the cavities or voids. On the other hand, a squeezing displacement which is too large would require an impractically large size of die-cast machine, although such a large squeezing displacement will be effective to prevent the formation of voids. Moreover, with a displacement too large, the ratio of the amount of molten metal constituting the product to the total amount of the molten metal injected by the injection plunger becomes unacceptably small, which is quite impractical from the view point of industrial utility.

DISCLOSURE OF THE INVENTION

Under these circumstances, the present invention aims at providing a die-casting method in which a molten metal is injected by an injection plunger into a die cavity through an injection passage and the molten metal injected into the die cavity is squeezed by a squeeze plunger movable through a squeeze passage provided separately from the runner, wherein:

(1) the squeezing is commenced at the latest before the runner is closed by the solidification of the molten metal therein and before the solidification of the metal in the die cavity has been developed too much;

(2) wherein the amount V of molten metal actually displaced by said squeeze plunger is given by:

$$V = \frac{\rho_o - \rho}{\rho_o} Va + \frac{\rho_o - \rho}{\rho_o} Vb \cdot K$$

where

Va represents the amount of molten metal in said die cavity and said squeeze passage;

Vb represents the amount of molten metal in said runner;

$\rho$ represents the density of a product obtained by a die-casting method which does not include a squeezing step;

$\rho_o$ represents the true density of the cast metal; and

K represents a practical squeeze factor which ranges from 0.3 to 1; and (3) wherein the squeezing pressure is greater than the sum of the injection pressure, a sliding frictional resistance generated during the movement of said squeeze plunger and a resistance generated during a shearing deformation of solidified layers formed at the forward end of the inner peripheral surface of said squeeze passage but is less than the total of said sum and a resistance generated during a shearing deformation of solidified layers formed opposite to said injection plunger.

According to the invention having above-stated features, it is possible to remarkably reduce the generation of cavities or voids which would adversely affect the strength, air-tightness and other characteristics of the die-cast product, and to assure a reliable manufacture of voidless die-cast products without substantial fluctuation of the quality.

BRIEF DESCRIPTION OF THE DRAWINGS

FIG. 9(*b*) is a side elevational view of the product shown in FIG. 9(*a*);

BEST MODE FOR CARRYING OUT THE INVENTION

The most preferred embodiment of the invention will be described hereinafter. A explanation will be made first with respect to the apparatus for use in carrying out the method of the invention, with reference to an illustrated example of the apparatus.

Figure 1:
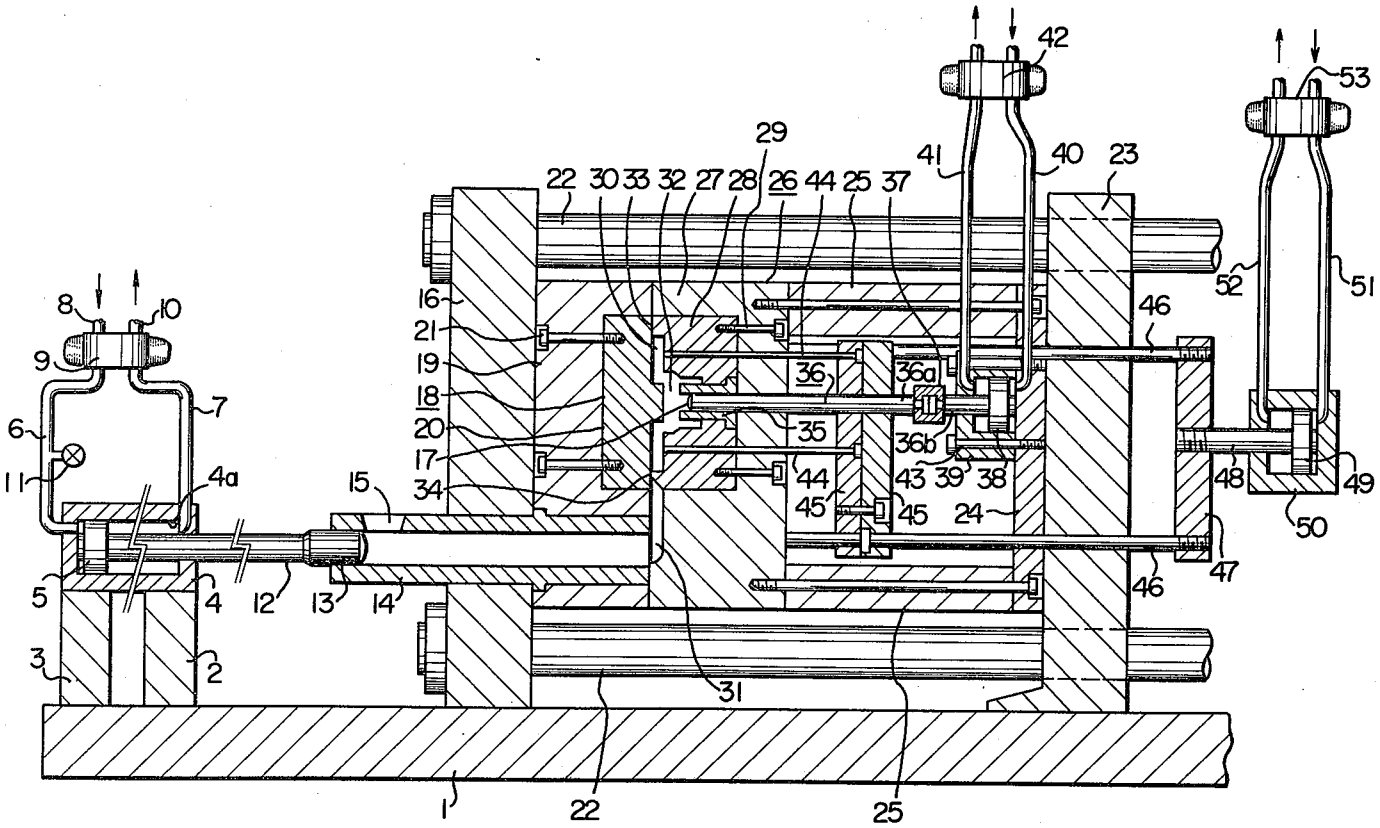
FIG. 1 is a sectional view of an example of apparatus used for carrying out the method of the invention.

Referring first to FIG. 1, a base 1 of the apparatus is fixedly installed on a foundation such as the floor of a factory by means of studs, not shown. Support members 2, 3 are fixed to the base 1 and stationarily support an injection cylinder 4. The injection cylinder 4 has a cylindrical inner surface 4*a* which slidably holds an injection piston 5 which is adapted to be moved right and left, as viewed in the drawing, by hydraulic signal pressure applied through first and second hydraulic signal pressure pipes 6, 7 opening in the opposite ends of the injection cylinder 4.

The hydraulic signal pressures are supplied by an oil pump, not shown, through an input pipe 8 and is selectively distributed to the first and second signal pressure pipes 6, 7 by means of a solenoid-controlled hydraulic pressure switching valve 9. The oil forced out from the injection cylinder 4 by the injection piston 5 is discharged through that signal pressure pipe 6 or 7 through which the signal pressure is not applied, and is returned to the pump (not shown) via the pressure switching valve 9 and an output pipe 10. A pressure switch 11 is disposed at an intermediate portion of the first signal pressure pipe 6 and is adapted to deliver an electric signal to a hydraulic pressure switching valve 42, to be discussed later, when a predetermined pressure level (e.g. a pressure which is 50 to 80% of the maximum injection pressure to be discussed later) is exceeded by the hydraulic pressure in the first signal pressure pipe 6.

The movement of the injection piston 5 is transmitted to a plunger tip 13 through a plunger rod 12, so that the plunger tip 13 is slidably moved right and left in a shot sleeve 14, as viewed on the drawing. A pouring port 15 opens in the upper wall of the shot sleeve 14 at the point which is cleared by the plunger tip 13 in its fully retracted position (shown in FIG. 1). A molten metal, such as an aluminum alloy, magnesium alloy, zinc alloy or the like, is poured by a pouring apparatus, not shown, into the shot sleeve 14 through the pouring port 15. Thus, the shot sleeve 14 constitutes a part of the injection passage through which the molten metal is injected. A fixed platen 16 is fixed to the base 1 and rigidly holds a fixed die 18. Another fixed platen is provided also at the right-hand end of a tie bar 22, although FIG. 1 shows only the one fixed platen 16 located at the left-hand end of the tie bar 22. In order to obtain a minute die shape as well as to ensure easy maintenance, the fixed die 18 is constituted by two separate parts; a holding block 19 made of ductile cast iron (FCD 55) and a impression block 20 made of a hot tool steel (SKD 61). The holding block 19 and the impression block 20 are rigidly connected to each other by means of hexagon socket-headed bolts 21. The aforementioned shot sleeve 14 extends through the fixed platen 16 and the holding block 19 and opens in one end face of the latter.

Two tie bars 22 are fixed to each of the upper and lower portions of the fixed platens 16. These tie bars 22 extend through a movable platen 23. The movable platen 23 is snugly and slidably received on tie bars 22 and is adapted to be moved along the base 1 to the right and left as viewed in the drawing by a driving power of a piston not shown.

A movable die 26 is fixed to the movable platen 23 through a side fixing plate 24 and upper and lower fixing plates 25, 25. As is the case of the fixed die 18, the movable die 26 is composed of two parts; a movable holding block 27 made of ductile cast iron (FCD 55) and a movable core 28 made of a hot tool steel (SKD 61), which are connected to each other by means of bolts 29.

As the movable platen 23 is moved by the piston not shown, the movable die 26 is brought into close contact with the fixed die 18. The two dies are shaped such that they define therebetween a die cavity 30 for die-casting the product, a runner 31 through which the molten metal is injected into the die cavity 30 and a squeezing passage 17 which opens to the cavity 30 at a piston of the latter remote from the runner 31. Gaps of from 0.1 mm to 0.5 mm are formed in the abutment surfaces of the fixed and movable dies 18 and 26 to define air vents 33 through which the air forced by the injected molten metal is relieved from the cavity 30. The end portion of the runner 31 adjacent to the cavity 30 is restricted to form a gate 34 so that the molten metal supplied from the runner 31 is injected into the cavity 30 at a high velocity.

A squeeze sleeve 35 is press-fitted into the central part of the movable core 28 so as to be positioned opposite substantially to the center of the die cavity 30. This squeeze sleeve 35 has a cylindrical shape and is made of a hot tool steel (SKD 61). The squeeze sleeve 35 closely and slidably receives a squeeze plunger 36 which is also made of hot tool steel (SKD 61). The aforementioned squeeze passage 17 is defined by the portion of the inner peripheral surface of the squeeze sleeve 35 extending beyond the inner left end surface of the squeeze plunger 36. By the squeeze plunger 36, the molten metal filling the squeeze passage 17 is forced out to a portion of the cavity 30 opposed to the squeeze passage 17 (i.e. to a molten metal accumulation space 32). For easy maintenance, the squeeze plunger 36 is composed of two members 36*a*, 36*b* which are connected to each other by a connecting ring 37, so that only the part slidably movable in the squeeze sleeve 35 can be replaced.

Figure 3:
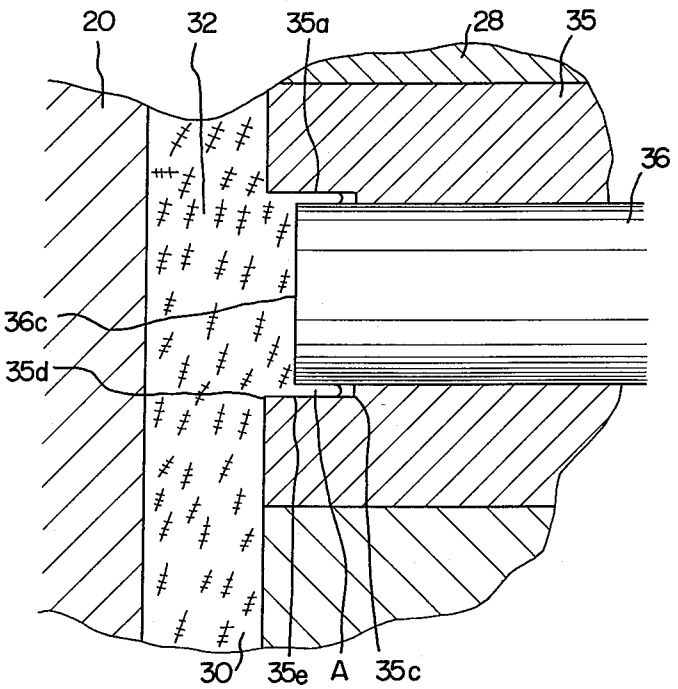
FIGS. 2 and 3 are sectional views of a part of the apparatus shown in FIG. 1, showing pressurizing plunger 36 and a metal accumulation space 32, FIG. 2 showing the pressurizing plunger 36 in its fully retracted position, and FIG. 3 showing the pressurizing plunger in its fully advanced position.
Figure 2:
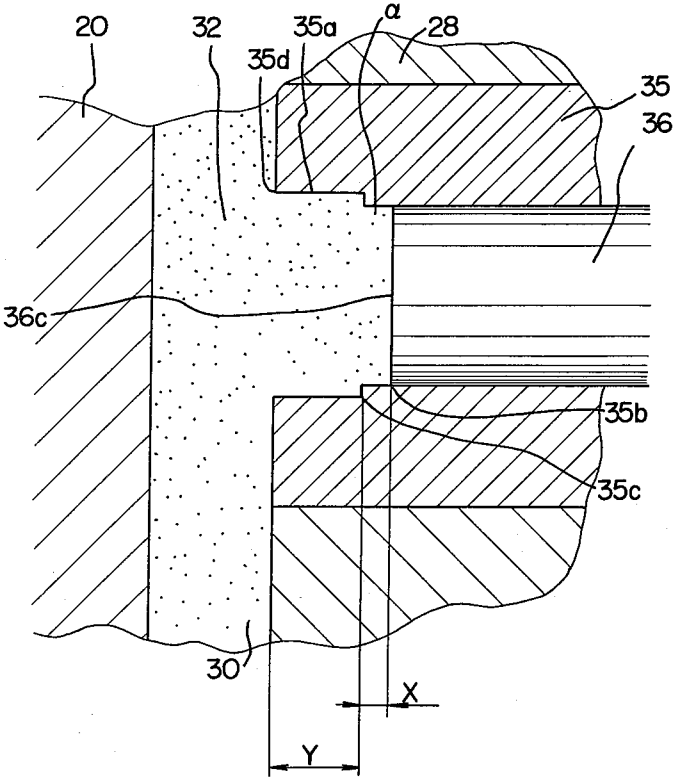

FIGS. 2 and 3 show the end portions of the squeeze sleeve 35 and the squeeze plunger 36 as well as the space 32. As will be seen in these Figures, the innermost portion 35*a* of the squeeze sleeve 35 has an inner diameter which is somewhat (0.05 to 1.00 mm or so) larger than that of the inner diameter of the other portions of the squeeze sleeve 35. When the squeeze plunger 36 is driven, the suface film of solidified layer $\beta$ formed at the surface portion of the molten metal in the squeeze passage 17 forms a ring-like fin A in the enlarged portion 35*a* of the squeeze sleeve 35 and the plunger 36 slides along the inner peripheral surface of the squeeze-sleeve 35 with the fin A interposed therebetween. The axial length y of this enlarged portion 35*a* is determined dependent on the amount of displacement of the metal effected by the squeeze plunger 36. More specifically, the enlarged portion 35*a* preferably extends from the inner end 35*d* of the squeeze sleeve 35 to a point 35*c* which is x (a distance which is not greater than 10 mm and preferably 2 to 3 mm) ahead of the position 35*b* of the end of the squeeze plunger 36 in its fully retracted position (position shown in FIG. 2). However, practically, no substantial problem is caused by increasing the length y to a point located rearwardly of the fully retracted position 35*b* of end surface of the plunger 36.

The stroke of the squeeze plunger 36 is so determined that the end 36*c* of the plunger 36 does not project beyond the inner end 35*d* of the squeeze sleeve 35 even when the squeeze plunger 36 is in its fully advanced position 35*e* (shown in FIG. 3) so squeeze plunger 36 never directly extends into the metal accumulation space 32.

In the illustrated embodiment, the space 32 is formed at a portion of the cavity 30 around an area opposite to the squeeze passage 17. The size of the space 32 is so selected that the space has a cross-sectional area throughout the space 32 which is greater than the cross-sectional area of the bore of the squeeze sleeve 35.

A squeeze piston 38 is connected to the outer end of the squeeze plunger 36 and is adapted to slide within a squeeze cylinder 39 so as to advance and retract the squeeze plunger 36. As is the case of the injection cylinder 4, third and fourth hydraulic signal pressure pipes 40, 41 are open in the squeeze cylinder 39. A solenoid-controlled oil pressure switching valve 42 is adapted to control the transmission of the signal pressure form an oil pump (not shown) to the signal pressure pipes 40, 41 thereby to control the movement of the squeeze piston 38. This squeeze cylinder 39 is fixed to the fixing plate 24 by means of bolts 43 so that the cylinder 39 is movable together with movable die 26.

Ejector pins 44 extend through the holding block 27 and the movable core 28 and have ends which are exposed to the die cavity 30 from the surface of the movable core 28. These ejector pins are adapted to separate and eject from the movable die 26 a die-cast product solidified in the cavity 30 after the movable die 26 is retracted to open the die. These ejector pins are driven to the right and left as viewed in the drawing by an ejector piston 49 and through an ejector plate 45, ejector rods 46, ejector plate 47 and an ejector actuating rod 48. These ejector rods 46 are slidably received by respective bores (not shown) formed in the holding block 27. The ejector piston 49 is adapted to slide within an ejector cylinder 50 in which are opened fifth and sixth hydraulic signal pressure pipes 51, 52, as is the cases of the injection cylinder 4 and the squeeze cylinder 39. A solenoid-controlled oil pressure switching valve 53 is adapted to control the hydraulic signal pressure from an oil pump (not shown) thereby to effect the forward and rearward movement of the ejector piston 49.

Hereinafter, the sequential steps of die-casting method of the invention will be described in detail.

[First Step]

The movable platen 23 is moved to the left as viewed in FIG. 1 by driving a piston which is not shown, so as to bring the movable die 26 into intimate contact with the fixed die 18, thereby to form the die cavity 30 for the die-casting of a product, and to form runner 31, squeeze passage 17 and air vents 33.

[Second Step]

Molten metal is poured from a pouring device, not shown, through the pouring port 15 into the shot sleeve 14 and further into a part of the runner 31. Then, the oil pressure switching valve 9 is operated to direct the signal pressure to the first signal pressure pipe 6, so that the injection piston 5 (and, accordingly, the plunger tip 13) are advanced at a predetermined pressure which is determined by the level of the signal pressure. By this forward movement of the plunger tip 13, the molten metal in the shot sleeve 14 is forced into the runner 31 and is injected to fill up the die cavity 30 and the squeeze passage 17. The injection is made at a high velocity because the molten metal is accelerated when it passes through the gate 34. The level of pressure applied to the molten metal in this step (i.e., the injection pressure) is 500 to 1500 atm. The air present in the cavity 30 and the metal accumulation space 32 would cause undesirable cavities or voids in a resultant product if the air is entrapped in the molten metal at the injection stage. Therefore, a part of the air in the die cavity 30 is relieved through the air vents 33 disposed at predetermined points of the abutment surfaces of the movable and fixed dies 26 and 18.

[Third Step]

After the filling up of the die cavity with the molten metal, the squeeze plunger 36 is driven to forcibly displace the molten metal from the squeeze passage 17 into the space 32 before the molten metal in the gate 34 is solidified.

Figure 4:
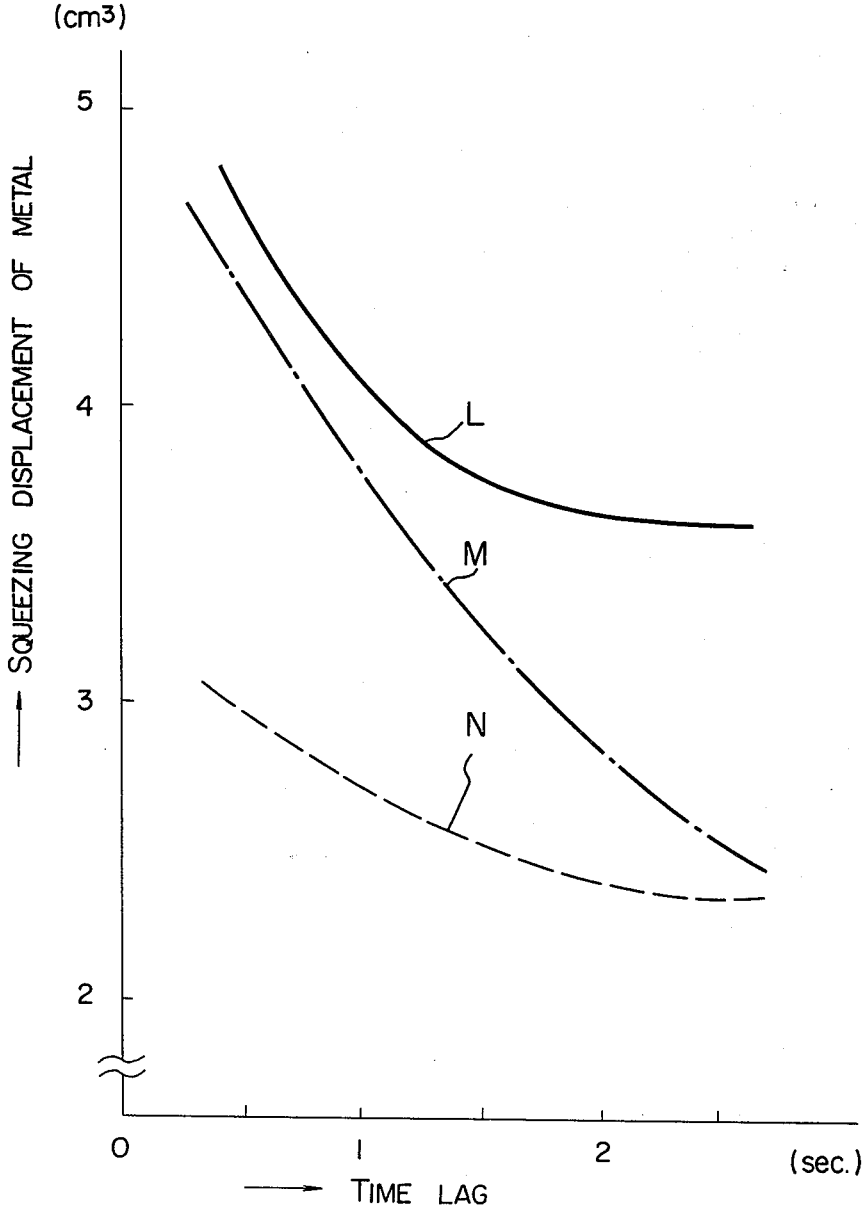
FIG. 4 is an illustration of the relationship between time lag and amount of the squeezing displacement of metal.

If the time period from the moment when the filling of the die cavity is completed to the moment when the squeeze is commenced (this time period will be referred to hereinafter as "time lag") is too long, the molten metal in the die cavity would be solidified. The solidified layer formed during this period of time lag is not squeezed and thus cannot be free from the production of cavities or voids, with the result that the resultant die-cast product includes portions which fail to provide sufficient strength and airtightness. Such cavities or voids, if formed once, must be removed or eliminated by squeezing the solidified layer at a very high pressure. In other words, for a given squeeze pressure, the increase in the time lag results in a decrease in the effectiveness of the squeeze. This fact has been confirmed also through experiments made by the present inventors on the relationship between the time lag and the squeezing displacement of metal, the result of the experiments being shown in FIG. 4. In FIG. 4, a full line curve L shows the result of the experiment conducted at a squeezing pressure of 2750 $Kg/cm^2$, while a dot-and-dash line curve M and a broken-line curve N respectively show the results of experiments conducted at squeezing pressures of 2125 $Kg/cm^2$ and 1500 $Kg/cm^2$.

Figure 5:
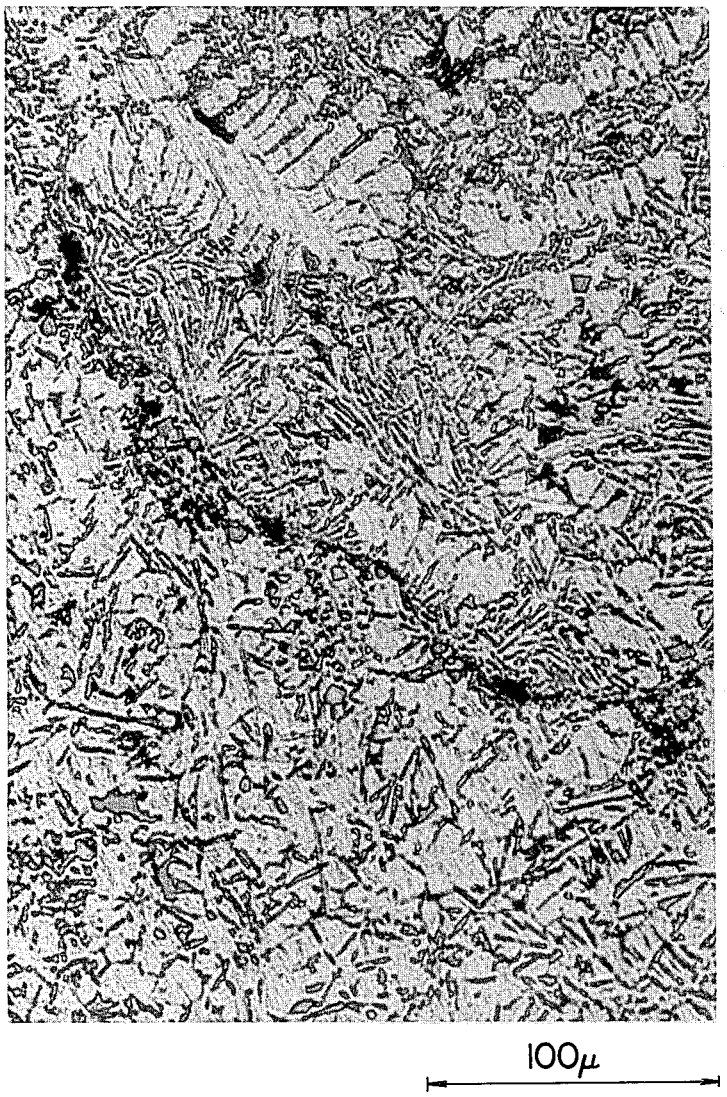
FIGS. 5(*a*) and 5(*b*) are photographs of die-cast structures heaving surface defects and segregations, respectively.
Figure 5:
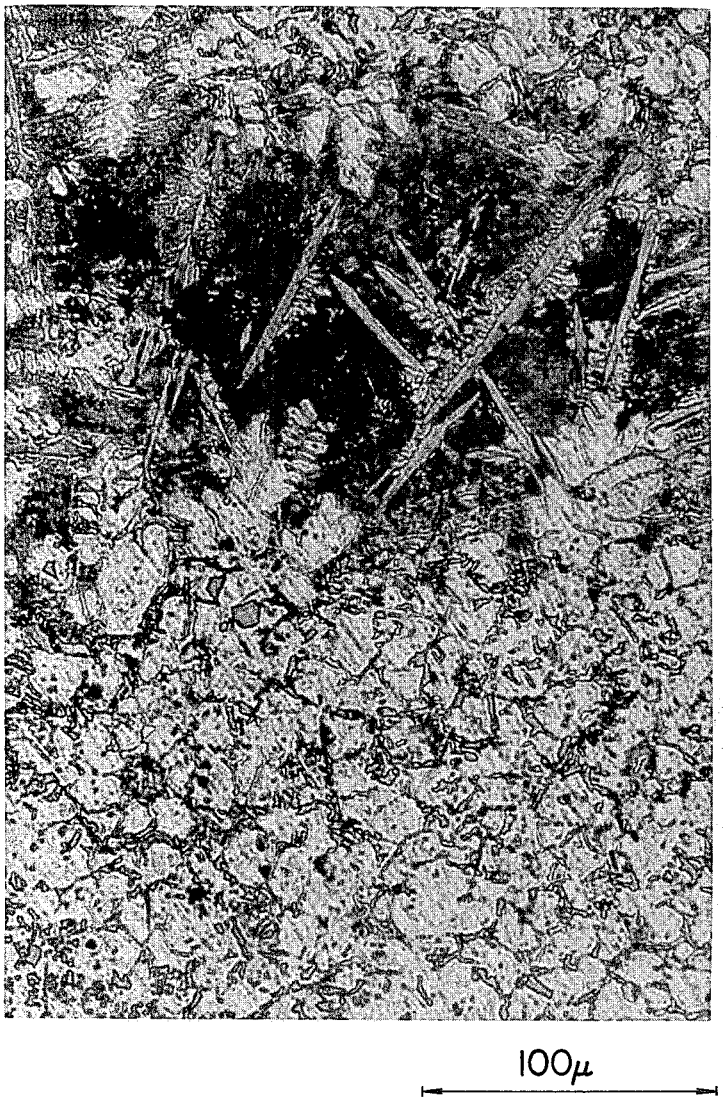

Further, when the time lag is too long, the solidified layer of the metal is sheared by the squeezing operation, so that the resultant die-cast product is liable to involve surface defects which undesirably lower the mechanical strength of the product. In addition, the metal which has been crystallized before the squeezing is locally concentrated to cause a segregation. The segregation adversely affects the workability (particularly for cutting) of the product and makes it difficult to precisely work the product. FIGS. 5(*a*) and 5(*b*) are photographs of structures of die-cast products having surface defects and segregations, respectively. These faults were both observed in the products produced with too long time lags.

It is, therefore, desirable to shorten the time lag as much as possible in order to avoid the surface defects and segregations.

In the described embodiment, the time lag is shortened by controlling the timing of commencement of the movement of the squeezing plunger 36 in the following manner.

Namely, when the die cavity 30 and the squeeze passage 17 have been completely filled with the molten metal, the forward movement of the injection plunger 13 is stopped with a resultant abrupt pressure rise in the first signal pressure pipe 6. Then, the pressure rise in this pipe 6 is detected by the pressure switch 11. The pressure switch 11 is adapted to deliver an electric signal to the oil pressure switching valve 42 when the pressure in the first signal pressure pipe 6 is increased beyond a predetermined pressure level. The oil pressure switching valve 42 then switches the transmission of the signal pressure to the third signal pressure pipe 40. It will be understood that, with the above-stated arrangement, it is possible to actuate the squeeze plunger 36 promptly (usually about 0.5 second or so) after the completion of the injection.

With the die-casting machine having the above-described construction, it usually takes about 5 to 6 seconds for the molten metal in the gate 34 to be solidified completely. Thus, according to the time lag employed in the described embodiment of invention, the squeeze action of the squeeze plunger 36 is commenced in a period of time which is sufficiently short as compared with the time required for the complete solidification of the molten metal in the gate 34.

[Fourth Step]

As the squeeze plunger 36 is driven promptly, the molten metal in the squeeze passage 17 is forced into the space 32 to displace the molten metal from the space 32. The squeezing pressure is transmitted not only to the molten metal in the die cavity 30, but also to the molten metal in the runner 31 and the shot sleeve 14 because the molten metal in the gate 34 is still unsolidified at this time.

Therefore, a squeezing displacement of molten metal equal only to the amount of metal required for the compensation of the shrinkage of molten metal in the die cavity 30 and the squeeze passage 17 is insufficient.

Figure 6:
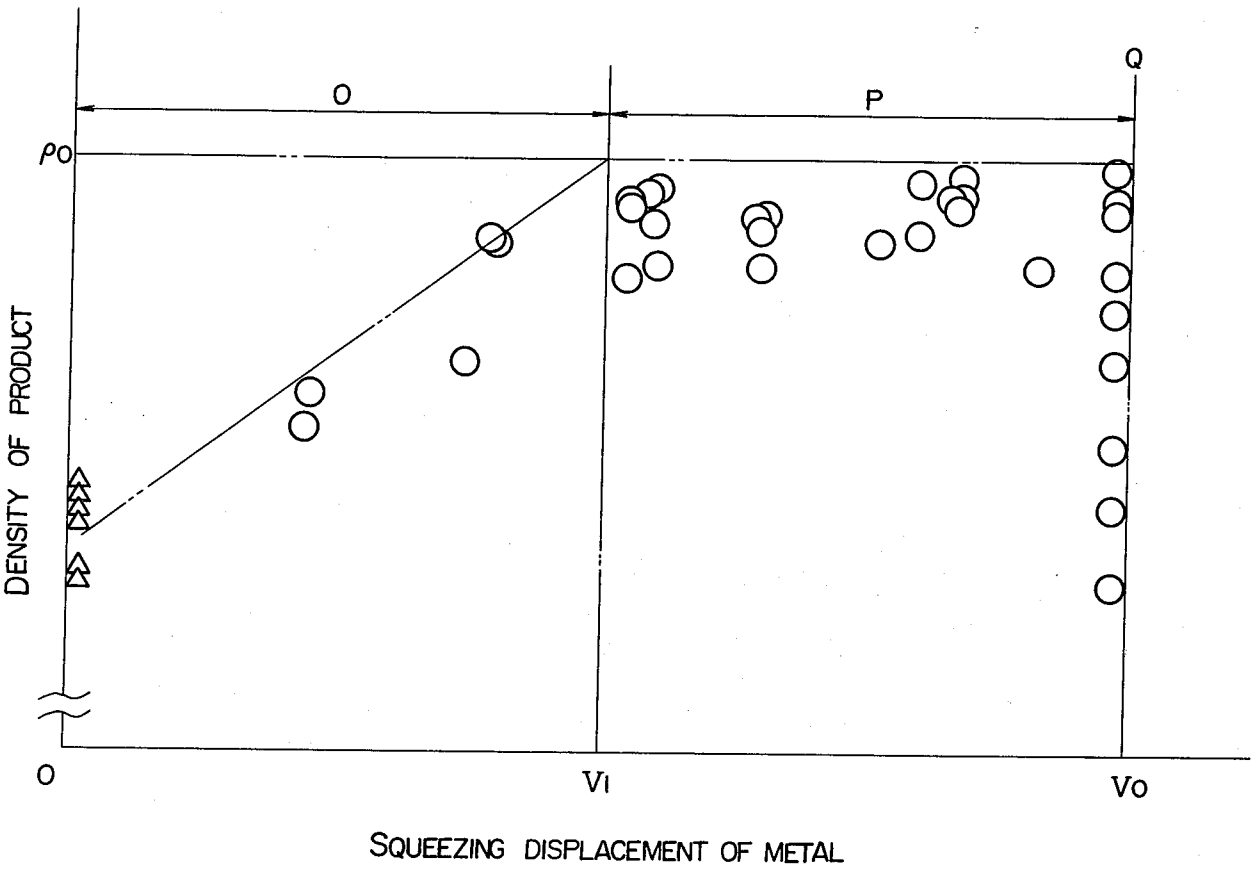
FIG. 6 is an illustration of the relationship between the amount of squeezing displacement of metal and the density of the die-cast product.

The inventors have made a series of experiments to examine the densities of the die-cast products obtained under various squeezing displacements of molten metal. A tendency was observed in the results of the experiments, as shown in FIG. 6 wherein points shown by Δ represent the densities of products produced by a die-casting method without squeezing step, while points shown by ○ represent the densities of the products obtained by the die-casting method of the invention, i.e. the densities of the bodies of the die-cast products from which the parts solidified in the squeeze passage 17 and the runner 31 have been cut away. $\rho_o$ represents the true density of the metal used for the die-casting (in the illustrated example, die-casting aluminum alloy was used), while $V_o$ represents the maximum squeezing displacement of molten metal which is determined by the area of the pressurizing surface of the squeeze plunger 36 and the maximum stroke of the squeeze plunger 36.

From FIG. 6, it will be seen that the density of the product is increased up to a predetermined squeezing displacement of metal $V_1$ (this region will be referred to as "first region O", hereinafter). Within a region between the above-mentioned predetermined displacement $V_1$ and the maximum displacement $V_o$, densities of the products are substantially close to the true density $\rho_o$. This region will be referred to as "second region P", hereinafter. At the maximum squeezing displacement $V_o$ of the molten metal, there appears a variety of product densities ranging from a value substantially equal to the density of the non-squeezed die-casting to a value substantially equal to the true density $\rho_o$ (This region will be referred to as "third region Q", hereinafter).

The variety of the product densities observed at the third region Q is believed to be due to the fact that the actual squeezing pressure in the die cavity 30 varies with different pressures applied by the squeeze plunger 36, even with the same squeezing displacement of molten metal. Namely, when the squeezing pressure exerted by the squeeze plunger 36 is unnecessarily high, the injection plunger tip 13 is forcibly moved back. Since the plunger tip 13 usually has a much larger diameter than that of the squeeze plunger 36 and thus, if the plunger tip 13 is forced back, the squeeze plunger 36 is instantaneously moved to its inner stroke end without effecting a substantial squeeze on the molten metal in the die cavity 30. As a result, even with the same squeezing maximum displacement $V_o$, the densities of the products largely fluctuate depending on whether the backward movement of the injection plunger tip 13 takes place or not, and on the degree of progress of the solidification attained at the moment when the backward movement of the injection plunger tip takes place.

It will be seen that the squeezing displacement of molten metal should preferably fall within the second region P.

The inventors have investigated the minimum value of squeezing displacement of molten metal $V_1$ which falls within the second region P. As a result, it has been found that there is a relationship expressed by the following equation;

$$V_1 = \frac{\rho_o - \rho}{\rho_o} Va \quad (1)$$

where $V_a$ represents the amount of molten metal in the die cavity 30 and the squeeze passage 17; and $\rho$ represents the mean value of the densities of products obtained by die-casting without squeeze, as indicated by $\Delta$ in FIG. 5.

Namely, this predetermined displacement $V_1$ is of the value at which the squeezing pressure imparted by the squeeze plunger 36 balances the force which is the sum of the injection pressure imparted by the injection plunger tip 13, flow resistance imparted by the gate 34 and other counteracting forces. In other words, the above-mentioned predetermined displacement is of the amount which is required to assure that the molten metal filling up the die cavity 30 and the squeeze passage 17 is solidified within the die cavity 30 without being caused to flow back into the runner 31 through the gate 34. For making the practical value V of squeezing displacement of molten metal coincident with the predetermined amount $V_1$ obtained by the equation (1), however, it is necessary to exquisitely or delicately adjust the squeezing pressure of the squeeze plunger 36 as stated above. Thus, for an efficient use of the method of the invention for industrial scale and purposes, the actual or practical value V of squeezing displacement of molten metal should be greater than the above-mentioned predetermined amount $V_1$ because it is extremely difficult to set the squeezing pressure of the squeeze plunger 36 at such a level as to always ensure satisfactory squeezing effect with the predetermined amount $V_1$.

It is believed that the constant density of the product obtained in the second region P over a wide range of the squeezing displacements of molten metal above the predetermined value $V_1$ is due to the fact that the amount of the squeezing displacement of molten metal in excess of the predetermined amount $V_1$ is spent to compensate for the solidification shrinkage of the metal in the runner 31 and shot sleeve 14. Thus, when the squeezing pressure of the squeeze plunger 36 is so selected as not to cause a forcible backward movement of the injection plunger tip 13, the molten metal displaced by the squeeze plunger 36 is all consumed to make up for the solidification shrinkage of the metal in the die cavity 30, runner 31 and the shot sleeve 14. Theoretically, therefore, the required squeezing displacement of molten metal should be obtained by the following equation:

$$V = \frac{\rho_o - \rho}{\rho_o} Va + \frac{\rho_o - \rho}{\rho_o} Vb \quad (2)$$

where Vb represents the amount of the molten metal with which the runner 31 and the shot sleeve 14 are filled. This amount will be referred to hereunder as "amount of molten metal of the runner side".

As a matter of fact, however, the gate 34 is considerably restricted as compared with the diameters of the runner 31 and the shot sleeve 14, and thus the solidification of the molten metal is completed in the gate 34 prior to the solidification of the molten metal of the runner side. Once the molten metal in the gate 34 is solidified, the squeezing pressure is no longer transmitted to the molten metal of the runner side. Therefore, the element $$\frac{\rho_o - \rho}{\rho_o} Vb$$

of the equation (2) gives an amount somewhat larger than that actually required.

The inventors have conducted experiments to investigate the squeezing displacements of molten metal and estimated the rates of solidification of the molten metal in the runner 31 and the shot sleeve 14 under various conditions. It was assumed that only 30 to 50% of the molten metal in the runner 31 and the shot sleeve 14 would have been solidified when the solidification is completed in the gate 34. Therefore, it is derived that the amount determined by the following equation is the minimum amount V of squeezing displacement of molten metal practically required:

$$V = \frac{\rho_o - \rho}{\rho_o} Va + \frac{\rho_o - \rho}{\rho_o} Vb \times (0.3 \sim 0.5) \quad (3)$$

In order that the amount determined by the equation (3) may be always used efficiently, it is necessary that the maximum amount $V_o$ of squeezing displacement of molten metal, which is determined by the pressurizing area and the stroke of the squeeze plunger 36, is greater than the amount derived from the equation (3). This is because, if the maximum amount $V_o$ of the squeezing displacement of molten metal were made equal to the amount determined by the equation (3), there would be raised a problem similar to the problem discussed in connection with the third region Q. Therefore, the maximum amount $V_o$ of the squeezing displacement of molten metal should be the amount determined by the following equation.

$$V_o = \frac{\rho_o - \rho}{\rho_o} Va + \frac{\rho_o - \rho}{\rho_o} Vb \cdot K \quad (4)$$

where K represents a maximum squeezing molten metal factor approximately equal to 1 (one). The factor K has been determined to be approximately equal to 1 for the following reasons. Namely, a too large maximum amount of squeezing displacement of molten metal would require an excessively high load on the squeeze piston 38 as well as impractically large sizes of the squeeze plunger 36 and the metal accumulation space 32. Thus, taking into consideration the difficulty in designing the die-casting machine and also the yield of the material (ratio of the amount of molten metal solidified in the die cavity 30 to the total amount of molten metal injected by the injection plunger tip 13), it is not preferred to employ a too large maximum amount $V_o$ of the squeezing displacement of molten metal.

Thus, the practical amount V of squeezing displacement of molten metal should be greater than the amount determined by the equation (3) but smaller than the amount $v_o$ determined by the equation (4). The practical amount V is, therefore, given by the following equation:

$$V = \frac{\rho_o - \rho}{\rho_o} Va + \frac{\rho_o - \rho}{\rho_o} Vb \cdot K \quad (5)$$

where K represents a practical squeezing molten metal factor which ranges from 0.3 to 1.

As will be understood also from the foregoing explanation, it is necessary to set the squeezing pressure by the squeeze plunger 36 at a predetermined level in order to obtain a squeezing displacement of metal which falls in the second region P shown in FIG. 6. Namely, a too small squeezing pressure will result in such an insufficient squeezing displacement of metal as is the case of the first region O. On the other hand, a too large squeezing pressure will undesirably force back the injection plunger tip 13, resulting in a squeezing in the third region $\phi$.

Figure 7:
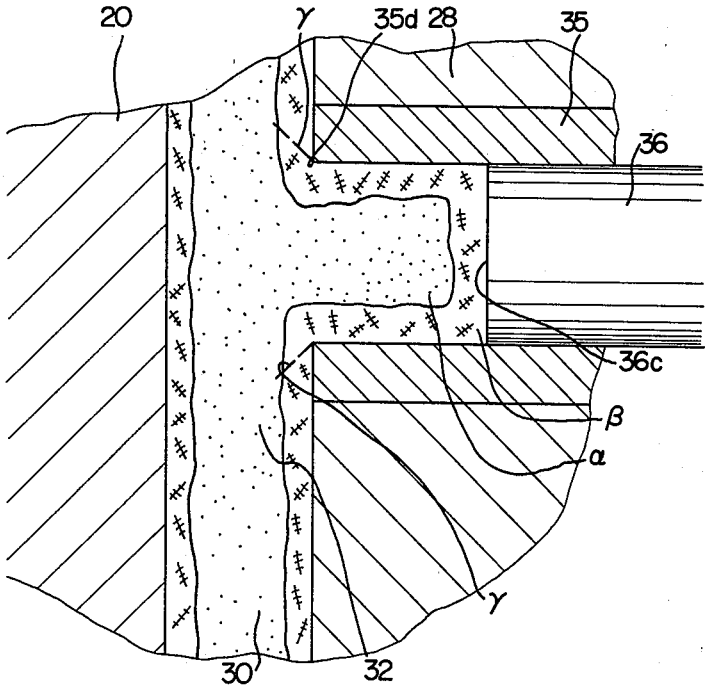
FIG. 7 is a sectional view of a part of the apparatus, showing a solidified layer $\beta$ formed in a squeeze passage 17.

Therefore, a minimum pressure $P_{min.}$ is required which is at least high enough to force the part $\alpha$ of molten metal from the squeeze passage 17 into the space 32. This minimum pressure $P_{min.}$ must be higher than the injection pressure $P_o$ exerted by the injection plunger tip 13, by a value which corresponds to the sum of the frictional resistance produced by the friction caused between the inner wall of the squeeze sleeve 35 and the solidified layer $\beta$ (see FIG. 7) in the squeeze passage 17 during the forward movement of the squeeze plunger 36, and of the resistance produced as a result of the shearing deformation $\gamma$ of the solidified layer $\beta$ formed at the inner end 35*d* of the inner peripheral surface of the squeeze sleeve 35.

Namely, the minimum pressure $P_{min.}$ is given by the following equations:

$$P_{min} \cdot \pi r^2 = P_o \pi r^2 + P_o \cdot 2\pi r \cdot L \cdot \mu + 2\pi r \cdot \sqrt{2} \cdot \epsilon(t_1) \cdot \tau \quad (6)$$

$$P_{min} = \frac{P_o(r + 2L\mu) + 2\sqrt{2}\,\epsilon(t_1) \cdot \tau}{r} \quad (7)$$

where r represents the radius of the squeeze plunger 36, while L represents the length, in the direction of movement of the plunger 36, of the area of contact between the solidified layer $\beta$ in the squeeze passage 17 and the inner peripheral surface of the squeeze sleeve 35; i.e. the axial length of the squeeze passage 17; The symbol $\mu$ represents the coefficient of sliding friction between the squeeze plunger 36 and the squeeze sleeve 35; The coefficient $\mu$ in the described apparatus was found to be 0.3 and usually is between 0.2 and 0.4. $\epsilon(t_1)$ represents the thickness of the solidified layer $\beta$ measured $t_1$ seconds after the filling; The symbol $\tau$ represents the magnitude of stress which is required for shearing the solidified layer $\beta$ and which ranges from 2 to 3 Kg/cm$^2$ in the case of an aluminum alloy.

Figure 8:
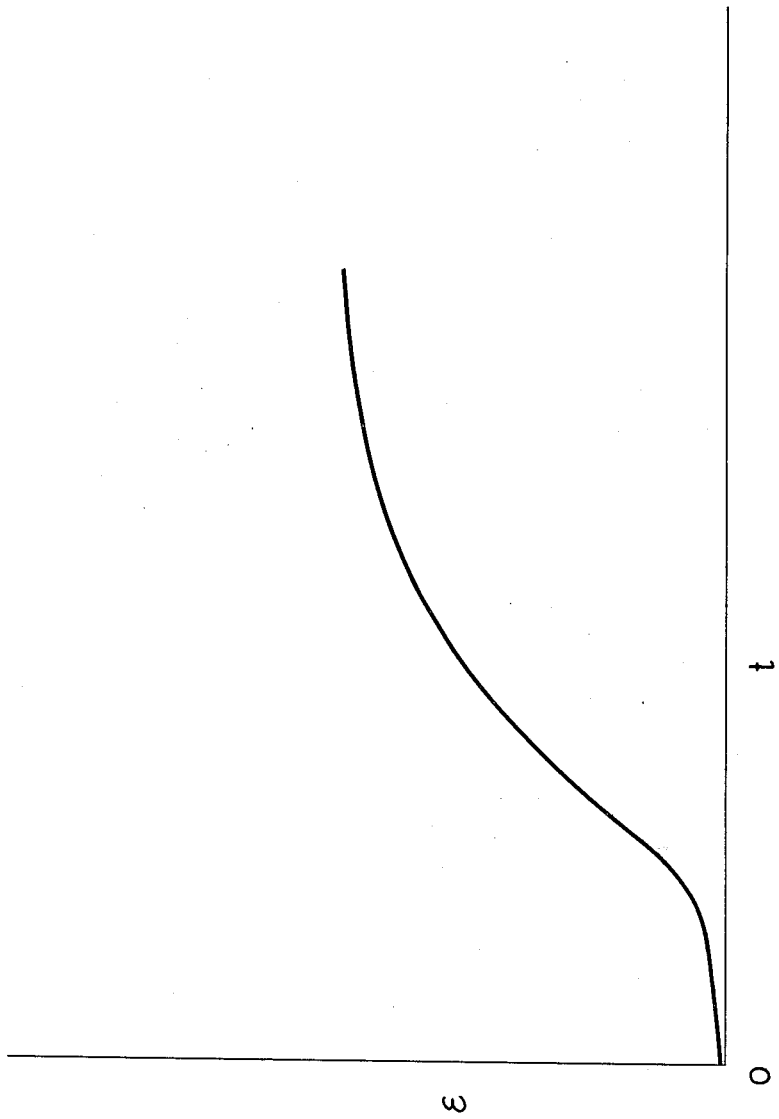
FIG. 8 is an illustration of the relationship between the thickness of the solidified layer and the time elapsed after the charging.

The inventors have made experiments under various squeeze pressures to seek for the relationship between the time t elapsed from the moment of completion of die filling and the thickness $\epsilon$ of the solidified layer $\beta$. As a result, a tendency as shown in FIG. 8 was observed. Through the experiments for obtaining the tendency as shown in FIG. 8, it has been found that the thickness $\epsilon(t=0.5)$ is about 1 mm in the case where the time lag t is 0.5 second.

The thickness of the shearing surface $\gamma$ was determined to be $\sqrt{2}\cdot\epsilon(t_1)$ because the shearing surface $\gamma$ is produced in a direction which is at an angle of 45° to the thicknesswise direction of the solidified layer $\beta$ in the case where the molten metal is aluminum.

The squeeze plunger 36 is allowed to move forward if the pressure is determined to exceed the minimum pressure $P_{min.}$ obtained by the above equation. Once the forward movement of the squeeze plunger 36 is started, the length L of the surface of contact is decreased, so that the pressure required for the squeezing is maintained higher than the minimum pressure $P_{min.}$ On the other hand, the upper limit or maximum allowable pressure $P_{max.}$ is the pressure which is the highest within such a range of pressure as would not cause a backward movement of the injection plunger tip 13. The pressure actually transmitted to the injection plunger tip 13 is lower than the pressure Pa imparted by the squeeze plunger 36, by a pressure corresponding to the pressure drop $\Delta P$ caused when the molten metal passes through the gate 34 and other part. Therefore, this pressure may be of such a level as not to shear the solidified layer $\beta$ formed around the inner end of the injection plunger tip 13. More specifically, it is necessary that a balance of pressures at the end of the injection plunger tip 13 is obtained as follows:

$$P_o \pi R^2 = (Pa - \Delta P)\pi(R - \epsilon(t_2))^2 - 2\pi(R - \epsilon(t_2)) \cdot \sqrt{2} \cdot \epsilon(t_2) \cdot \tau \quad (8)$$

where R is the radius of the plunger tip 13.

Then, the following equation is derived from the equation (8):

$$Pa = \frac{P_o R^2 + 2(R - \epsilon(t_2) \cdot \sqrt{2} \cdot \epsilon(t_2) \cdot \tau}{(R - \epsilon(t_2))^2} + \Delta P \quad (9)$$

In addition, the relationship between the pressure Pa of the molten metal squeezed by the squeeze plunger 36 and the maximum pressure of the same plunger 36 is represented by:

$$P_{max} \cdot \pi \cdot r^2 = Pa\pi r^2 + Pa \cdot 2\pi r \cdot L' \cdot \mu + 2\pi r\sqrt{2}\,\epsilon(t_2) \cdot \tau \quad (10)$$

$$Pa = \frac{P_{max} \cdot r - 2\sqrt{2}\,\epsilon(t_2) \cdot \tau}{r + 2L'\mu} \quad (11)$$

where L' represents the length of the surface of contact at the time of $t_2$.

Therefore, the maximum pressure of the squeeze plunger 36 is given by the following equation:

$$P_{max} = \frac{(r + 2L'\mu)(P_o R^2 + 2(R - \epsilon(t_2)\sqrt{2}\,\epsilon(t_2) \cdot \tau}{(R - \epsilon(t_2))^2 \cdot r} + \quad (12)$$

-continued $$\frac{(r + 2L'\mu)\Delta P}{r} + \frac{2\sqrt{2}\ \epsilon(t_2)\cdot\tau}{r}$$

However, in actual use of the method of the invention in an industrial scale, it is thought that, if the maximum pressure $P_{max}$ determined by the equation (12) is used, the squeezing pressure would in many cases be unduly high to produce fluctuations of the pressure drop $\Delta P$, thickness $\epsilon$ of the solidified layer $\beta$ and so on in die-casting certain kinds of products. It is therefore necessary that the practically used maximum pressure $P_{max}'$ is made smaller than the maximum pressure $P_{max}$ obtained from the above equation. The pressure drop $\Delta P$ is difficult to quantitatively determine as compared with other factors. Therefore, the pressure obtained by subtracting the term of pressure drop $\Delta P$, i.e.

$$\frac{(r + 2L'\mu)\Delta P}{r},$$

from the maximum pressure $P_{max}$ obtained by the above equation is used as the practically usable maximum pressure $P_{max}'$.

In the determination of the thickness $\epsilon$ of the solidified layer $\beta$, the results of experiments made by the present inventors show that a practical value of the time $t_2$ after the filling of dies can be made approximately equal to the time required by the squeeze plunger 36 to travel to the midway of the squeeze passage 17.

The molten metal in the squeeze passage 17 is squeezed at a predetermined pressure between the aforementioned minimum pressure $P_{min}$ and the practically usable maximum pressure $P_{max}'$. The squeezing pressure is maintained until the solidification in the die cavity 30 is completed, i.e. until the molten metal on the side of the gate 34 adjacent to the die cavity 30 is completely solidified.

[Fifth Step]

After the injected metal on the side of the gate 34 adjacent to the die cavity 30 is solidified, any further application of pressure by the squeeze plunger 36 will not be effective to squeeze the metal. Thus, the oil pressure switching valve 42 is operated to feed the signal pressure now to the fourth signal oil pressure pipe 41 thereby to retract the squeeze plunger 36.

The time required for the solidification of the metal in the die cavity 30 varies with the volume and spatial height of the die cavity. It is therefore preferred to experimentally retract the squeeze plunger 36 at various timings to preliminarily measure the time required for the solidification and to operate the oil pressure switching valve 42 by means of a timer after the elapse of a time period which is the sum of the above measured time and a predetermined additional time (which may be, 1 or 2 seconds).

[Sixth Step]

After the retraction of the squeeze plunger 36, the piston not shown is actuated to move the movable platen 23 to the right as viewed in FIG. 1 to separate the movable die 26 from the fixed die 18.

The separation of the movable die 26 may be made at such a timing when the outer surface of the molten metal on the side of the injection passage has been solidified to such an extent as to maintain the shape of the die-cast product. In the described embodiment, the movable die 26 is separated at a timing of 0.5 to 1 second after the retraction of the squeeze plunger 36.

The pressure signal applied to the first signal pressure pipe 6 is still maintained when the movable die 26 is separated, so that a die-cast product solidified in the shot sleeve 14 may be forced out therefrom.

Then, the signal pressure is switched to the second signal pressure pipe 7 by the oil pressure switching valve 9 thereby to retract the injection plunger tip 13. Subsequently, the pressure switching valve 53 is operated to switch the signal oil pressure to the fifth signal pressure pipe 51 so as to move the ejector piston 49 to the left as viewed in FIG. 1. This leftward movement of the ejector piston 49 is transmitted to the ejector pins 44 through the ejector actuating rod 48, ejector plate 47, ejector rods 46 and the ejector plate 45. As a result, the die-cast product which has been solidified in the die cavity 30, runner 31 and the squeeze passage 17 is ejected by the ejector pins 44.

Figure 9:
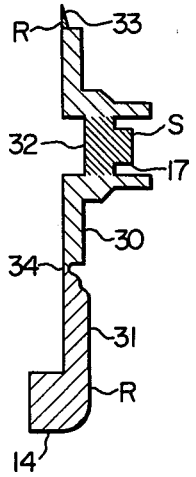
FIG. 9(*a*) is a sectional view of a die-cast product produced by the apparatus shown in FIG. 1.
Figure 9:
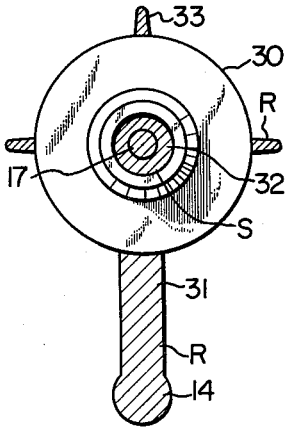

The process of the die-casting method of the invention is now completed. The product obtained by this die-casting method has a shape as shown in FIGS. 9(*a*) and 9(*b*). After the die-casting, the portions which have been solidified in the shot sleeve 14, the runner 31 and the air vents 33 (wide hatched portions R in FIGS. 9(*a*), 9(*b*) are cut away by a press and the portion which has been solidified in the metal accumulation space 32 (closely hatched portion S in FIGS. 9(*a*), 9(*b*)) is removed by machining to complete a product.

It is possible to use a part or the whole of the portion S solidified in the space 32 as a part of the final product. This portion, however, is preferably removed by cutting for the following reason.

The molten metal in the space 32 is directly squeezed by the squeeze plunger 36 and the solidification proceeds under this condition. The solidified layer $\beta$ generated in this portion is thus subjected to shearing before it grows sufficiently, with resultant occurrence of undesirable surface defects. In addition, since the time required for the crystallization of molten metals varies with kinds of the metals cast, the metal which is still in fluid state is forced out of the space 32 by the squeezing plunger 36 while the metal which has been crystallized in the space would remain therein, with resultant generation of segregation.

As stated before, surface defect and segregation adversely affect the strength and workability of the die-cast product. Thus, the portion solidified in the well 32 should preferable be removed particularly in the cases where the die-cast product is intended for use under a high pressure or is subjected to precision-working.

Figure 10:
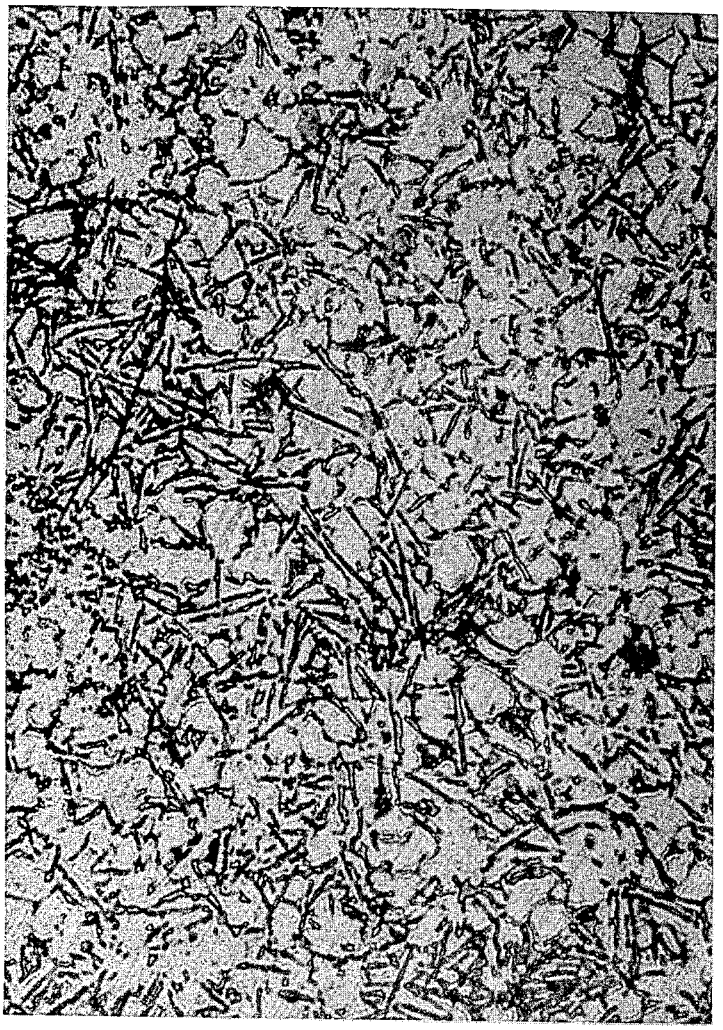
FIG. 10 is a photograph of the structure of the product produced in accordance with the method of the invention.

In contrast to the above, the portion solidified in the die cavity 30 does not include any faults such as surface defect and segregation because the molten metal in the die cavity 30 is not directly squeezed by the squeeze plunger 36. FIG. 10 is a photograph showing the structure of the portion of the die-cast product solidified in the die cavity 30. It will be seen also in this drawing that the die-cast product produced by the die-casting method of the invention is free from the faults such as cavities or voids, surface defect, segregation and so forth.

Figure 11:
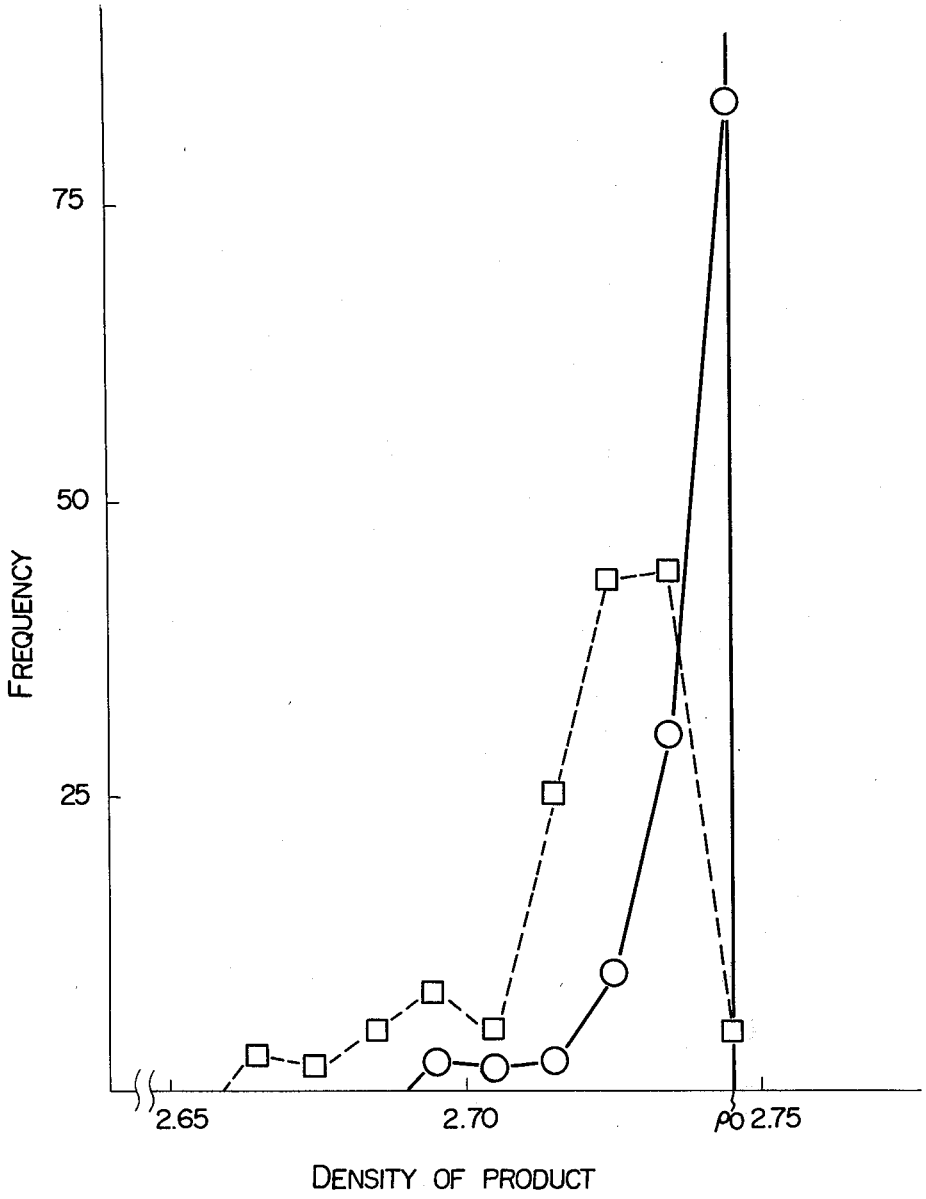
FIG. 11 is an illustration showing the difference in density between products produced by the method in accordance with the invention and products produced by a die-casting method which does not include the squeezing of cast metal.

FIG. 11 shows the distribution of densities (marked at ○) of products an aluminum alloy, produced by the die-casting method of the invention and the distribution of densities (marked at □) of products of a similar aluminum alloy produced by the conventional die-casting method without squeezing step. The density distribution was measured by cutting each die-cast product into 136 pieces, measuring the densities of respective pieces, and counting the numbers of pieces belonging to each of a plurality of density values. The numbers of pieces counted for respective density values are shown in FIG. 11. As will be clearly seen from FIG. 11, the product obtained by the die-casting method of the invention has a density value which is approximately close to the true density. In addition, the generation of voids or cavities which most adversely affect the mechanical strength and gas-tightness is avoided almost completely by the present invention.

Needless to say, it is not essential for the invention to dispose the squeeze plunger 36 in the movable die 26. The squeeze plunger may alternatively be incorporated in the fixed die 18 installed for sliding movement along the abutment surfaces of the fixed and movable dies 18 and 26.

Although the metal accumulation space 32 is formed integral with the die cavity 30 in the illustrated embodiment, it is not essential to dispose the space 32 in the die cavity 30. An arrangement in which the space 32 is provided in communication with the die cavity 30 and the squeeze passage 17 opens to the space 32 will provide a similar result.

INDUSTRIAL APPLICABILITY

The die-casting method of the invention, which can remarkably suppress and diminish the generation of cavities or voids which adversely affect the gas-tightness and mechanical strength of the cast products, can suitably and effectively be applied to the production of articles which are intended for use under high pressure and products which must be precisely worked. The method may be applied to the manufacture of, for example, housings of compressors, pumps and so on.

We claim:

1. A die-casting method comprising:

a first step of relatively moving dies into close contact so as to form therebetween a die cavity for casting a product, a runner through which molten metal is injected into said die cavity, and a substantially non-narrowing squeeze passage connected directly to said die cavity at a point other than the point of connection between said die cavity and said runner;

a second step of injecting, by forwardly moving an injection plunger to effect a predetermined injection pressure, the molten metal from said runner via a gate into said die cavity and said squeeze passage to fill said die cavity and said squeeze passage with the molten metal;

a third step of starting a squeezing displacement of the molten metal in said non-narrowing squeeze passage by moving a squeeze plunger through said squeeze passage from a position therein remote from said die cavity toward said die cavity and at a predetermined squeezing pressure greater than said injection pressure and at a time before said gate is blocked by solidified molten metal;

a fourth step of continuing the squeezing on said molten metal by said squeeze plunger in said passage at said predetermined squeezing pressure until said cavity is filled voidlessly and, during said continued squeezing, forcing molten metal out of said die cavity through said gate into said runner by the molten metal displaced out of said squeeze passage by said squeeze plunger and until the molten metal is completely solidified at least in said die cavity while retaining said squeeze plunger substantially fully inside said passage to produce a solidified voidless die-cast product;

a fifth step of retracting said squeeze plunger to remove said squeezing pressure from said squeeze passage after the molten metal is solidified in said die cavity;

a sixth step of relatively moving said dies away from one another for the removal of said die-cast product which has been solidified in said die cavity; and preventing said injection plunger from being moved backward during said third and fourth steps by the effect of said greater pressure applied by said squeeze plunger.

2. A die-casting method comprising:

a first step of relatively moving dies into close contact so as to form therebetween a die cavity for casting a product, a runner connected to said die cavity by a gate and through which molten metal is injected into said die cavity, and a non-narrowing squeeze passage directly connected to said die cavity at a point other than the point of connection between said die cavity and said runner;

a second step of injecting, by forward movement of an injection plunger operated in a sleeve connected to said die cavity by said runner and gate and at a predetermined injection pressure, the molten metal from said runner via said gate into said die cavity and said squeeze passage to fill said die cavity and said squeeze passage with the molten metal;

a third step of starting a squeezing displacement of the molten metal in said non-narrowing squeeze passage by moving a squeeze plunger through said squeeze passage from a position therein remote from said die cavity toward said die cavity and at a predetermined squeezing pressure greater than said injection pressure and at a time before the molten metal is solidified to block said gate;

a fourth step of continuing the squeezing on said molten metal by said squeeze plunger in said passage at said predetermined squeezing pressure until said cavity is filled voidlessly and, during said continued squeezing, forcing molten metal out of said die cavity through said gate into said runner by the molten metal displaced out of said squeeze passage by said squeeze plunger and until the molten metal is completely solidified at least in said die cavity while retaining said squeeze plunger substantially fully inside said passage to produce a solidified voidless die-cast product;

a fifth step of retracting said squeeze plunger to remove said squeezing pressure from said squeeze passage after the molten metal is solidified in said die cavity;

a sixth step of relatively moving said dies away from one another for the removal of the die-cast product which has been solidified in said die cavity; and preventing said injection plunger from being moved backward during said third and fourth steps by the effect of said greater pressure applied by said squeeze plunger, wherein said first to sixth steps are carried out in sequence;

wherein the amount V of molten metal actually displaced by said squeeze plunger is given by:

$$V = \frac{(\rho_o - \rho)(Va)}{\rho_o} + \frac{(\rho_o - \rho)(Vb)(K)}{\rho_o}$$

where

Va represents the amount of molten metal in said die cavity and said squeeze passage;

Vb represents the amount of molten metal in said runner and said sleeve;

$\rho$ represents the density of a product obtained by a die-casting method which does not include a squeezing step;

$\rho_o$ represents the true density of the cast metal; and

K represents a practical squeeze factor which ranges from 0.3 to 1; and wherein said predetermined squeezing pressure is:

(A) greater than the sum of the injection pressure, a sliding frictional resistance generated during the movement of said squeeze plunger and a resistance generated during a shearing deformation of a solidified layer formed at the forward end of the inner peripheral surface of said squeeze passage, but is (B) less than the total of said sum and a resistance generated during a shearing deformation of a solidified layer formed in front of said injection plunger.

3. A method for die-casting a product, wherein relatively movable dies are used to form a die cavity which corresponds to said product, a sleeve is connected with said die cavity to introduce a molten metal to said die cavity, an injection plunger is fitted in said sleeve to inject said molten metal in said sleeve into said die cavity at a predetermined injection pressure, a non-narrowing squeeze passage is connected directly to said die cavity, a squeeze plunger is fitted in said squeeze passage to force received molten metal back into said die cavity, said cavity having a cross-sectional area larger than the transverse cross-sectional area of said squeeze passage, a runner is provided to connect said sleeve with said die cavity, and a gate is formed at the connection between said runner and said die cavity to throttle said molten metal to be injected into said die cavity, comprising the steps of:

driving said injection plunger to inject said molten metal in said sleeve into said die cavity through said runner and said gate at said predetermined injection pressure to fill said die cavity and said squeeze passage, driving said squeeze plunger through said non-narrowing squeeze passage from a position therein remote from said die cavity toward said die cavity to press out said molten metal in said squeeze passage into said die cavity to apply a predetermined squeezing pressure to said molten metal in said die cavity continuously until said molten metal therein is completely solidified thereby to obtain a void free product in said die cavity, retaining said squeeze plunger substantially fully in said squeeze passage while said squeezing pressure is being applied, said squeeze plunger being driven before said molten metal solidifies substantially in said gate to ensure that thick solidified layers do not grow at peripheral portions of said molten metal in said die cavity and said squeeze passage, said predetermined squeezing pressure being larger than the sum of said predetermined injection pressure and the pressure to shear a solidified layer grown around an outlet of said squeeze passage and to slide out said molten metal in said squeeze passage and any solidified layer grown at a circumferential portion thereof, but smaller than a pressure which moves back said injection plunger in said sleeve, said molten metal in said die cavity being forced back through said gate into said runner, said squeeze plunger being driven in said passage in such a manner as to push a tubular solidified layer in said squeeze passage at least partially out of said non-narrowing squeeze passage into said cavity.

4. A method for die-casting a product, wherein relatively movable dies are used to form a die cavity which corresponds to said product, a sleeve is connected with said die cavity to introduce a molten metal to said die cavity, an injection plunger is fitted in said sleeve to inject said molten metal in said sleeve into said die cavity at a predetermined injection pressure, a non-narrowing squeeze passage is connected directly to said die cavity, a squeeze plunger is fitted in said squeeze passage to force molten metal received in said passage back into said die cavity, said cavity having a cross-sectional area larger than the transverse cross-sectional area of said squeeze passage, a runner is provided to connect said sleeve with said die cavity, and a gate is formed at the connection between said runner and said die cavity to throttle said molten metal to be injected into said die cavity, comprising the steps of:

driving said injection plunger to inject said molten metal in said sleeve into said die cavity through said runner and said gate at said predetermined injection pressure to fill said die cavity and said squeeze passage, driving said squeeze plunger through said non-narrowing squeeze passage from a position therein remote from said die cavity toward said die cavity to press out said molten metal in said squeeze passage into said die cavity to apply a predetermined squeezing pressure to said molten metal in said die cavity continuously until said molten metal therein is completely solidified thereby to obtain a void free product in said die cavity, retaining said squeeze plunger substantially fully inside said squeeze passage while said squeezing pressure is being applied, said squeeze plunger being driven before said molten metal solidifies substantially in said gate to ensure that thick solidified layers do not grow at peripheral portions of said molten metal in said die cavity and said squeeze passage, said predetermined squeezing pressure being larger than said injection pressure but smaller than the pressure which moves back said injection plunger, and said molten metal pressed out of said squeeze passage and into said die cavity to fill up said die cavity being forced back through said gate into said runner and at least toward said sleeve.

5. A method as in claim 3 or 4 wherein the amount V of molten metal actually displaced by said squeeze plunger is given by:

$$V = \frac{(\rho_o - \rho)(Va)}{\rho_o} + \frac{(\rho_o - \rho)(Vb)(K)}{\rho_o}$$

where

Va represents the amount of molten metal in said die cavity and said squeeze passage;

Vb represents the amount of molten metal in said runner and said sleeve;

$\rho$ represents the density of a product obtained by a die-casting method which does not include a squeezing step;

$\rho_o$ represents the true density of the cast metal; and

K represents a practical squeeze factor which ranges from 0.3 to 1; and wherein said squeezing pressure is:

(A) greater than the sum of the injection pressure, a sliding frictional resistance generated during the movement of said squeeze plunger and a resistance generated during a shearing deformation of a solidified layer formed at the forward end of the inner peripheral surface of said squeeze passage, but (B) less than the total of said sum and a resistance generated during a shearing deformation of a solidified layer formed in front of said injection plunger.

6. A die-casting method comprising:

a first step of relatively moving dies into close contact with one another so as to form therebetween a die cavity for casting a product, a runner connected to said die cavity by a gate, and a substantially non-narrowing squeeze passage communicated with said die cavity at a point other than the point of connection between said die cavity and said runner;

a second step of injecting, by an injection plunger and at a predetermined injection pressure, the molten metal from said runner via said gate into said die cavity and said squeeze passage to fill said die cavity and said squeeze passage with the molten metal;

a third step of starting a squeezing displacement of the molten metal in said squeeze passage by moving a squeeze plunger from a position in said passage remote from said die cavity toward said die cavity and at a predetermined squeezing pressure greater than said predetermined injection pressure and at a time before said gate is blocked by solidified molten metal;

a fourth step of continuing the squeezing on said molten metal by said squeeze plunger at said predetermined squeezing pressure to fill said cavity with molten metal and, during said continued squeezing, forcing molten metal out of said die cavity through said gate into said runner until the molten metal is completely solidified at least in said die cavity while retaining said squeeze plunger substantially fully inside said passage to produce a solidified voidless die-cast product;

preventing said injection plunger from being moved backward by the effect of said greater pressure applied by said squeeze plunger during said third and fourth steps;

a fifth step of retracting said squeeze plunger to remove said squeezing pressure from said squeeze passage after the molten metal is solidified in said die cavity; and a sixth step of relatively moving said dies away from one another for the removal of said die-cast product which has been solidified in said die cavity.

7. A die-casting method comprising:

a first step of relatively moving dies into close contact with one another so as to form therebetween a die cavity for casting a product, a runner connected to said die cavity by a gate and through which molten metal is injected into said die cavity, and a substantially non-narrowing squeeze passage communicated with said die cavity at a point other than the point of connection between said die cavity and said runner;

a second step of injecting, by an injection plunger operated in a sleeve connected to said die cavity by said runner and gate and at a predetermined injection pressure, the molten metal from said runner via said gate into said die cavity and said squeeze passage to fill said cavity and passage with the molten metal;

a third step of starting a squeezing displacement of the molten metal in said squeeze passage by moving a squeeze plunger from a position in said passage remote from said die cavity toward said die cavity and at a predetermined squeezing pressure and at a time before said gate is blocked by solidified molten metal;

a fourth step of continuing the squeezing on said molten metal by said squeeze plunger at said predetermined squeezing pressure to fill said cavity with molten metal and, during said continued squeezing, forcing molten metal out of said die cavity through said gate into said runner until the molten metal is completely solidified at least in said die cavity to produce a solidified die-cast product;

preventing said injection plunger from being moved back by the effect of the pressure applied by said squeeze plunger during said third and fourth steps;

a fifth step of retracting said squeeze plunger to remove said squeezing pressure from said squeeze passage after the molten metal is solidified in said die cavity; and a sixth step of relatively moving said dies away from one another for the removal of said die-cast product which has been solidified in said die cavity;

wherein said first to sixth steps are carried out in sequence;

wherein the amount V of molten metal actually displaced by said plunger is given by $$V = \frac{(\rho_o - \rho)(Va)}{\rho_o} + \frac{(\rho_o - \rho)(Vb)(K)}{\rho_o}$$

where

Va represents the amount of molten metal in said die cavity and said squeeze passage;

Vb represents the amount of molten metal in said runner and said sleeve;

$\rho$ represents the density of a product obtained by a die-casting method which does not include a squeezing step;

$\rho_o$ represents the true density of the cast metal;

K represents a practical squeeze factor which ranges from 0.3 to 1; and wherein the squeezing pressure is:

(A) greater than the sum of the injection pressure, a sliding frictional resistance generated during the movement of said squeeze plunger and a resistance generated during a shearing deformation of a solidified layer formed at the forward end of the inner peripheral surface of said squeeze passage, but (B) less than the total of said sum and a resistance generated during a shearing deformation of a solidified layer formed in front of said injection plunger.

8. A method as in claim 1, 3, 4 or 6 wherein said predetermined squeezing pressure is:

(A) greater than the sum of the injection pressure, a sliding frictional resistance generated during the movement of said squeeze plunger and a resistance generated during a shearing deformation of a solidified layer formed at the forward end of the inner peripheral surface of said squeeze passage, but (B) less than the total of said sum and a resistance generated during a shearing deformation of a solidified layer formed in front of said injection plunger.

9. A die-casting method comprising:

a first step of relatively moving dies into close contact with one another so as to form therebetween a die cavity for casting a product, a runner connected to said die cavity by a gate and through which molten metal is injected into said die cavity, and a substantially non-narrowing squeeze passage communicated with said die cavity at a point other than the point of connection between said die cavity and said runner;

a second step of injecting, by an injection plunger operated in a sleeve connected to said die cavity by said runner and gate and at a predetermined injection pressure, the molten metal from said runner via said gate into said die cavity and said squeeze passage to fill said cavity and passage with the molten metal;

a third step of starting a squeezing displacement of the molten metal in said squeeze passage by moving a squeeze plunger from a position in said passage remote from said die cavity toward said die cavity and at a predetermined squeezing pressure and at a time before said gate is blocked by solidified molten metal;

a fourth step of continuing the squeezing on said molten metal by said squeeze plunger at said predetermined squeezing pressure to fill said cavity with molten metal and, during said continued squeezing, forcing molten metal out of said die cavity through said gate into said runner until the molten metal is completely solidified at least in said die cavity to produce a solidified die-cast product;

preventing said injection plunger from being moved back by the effect of the pressure applied by said squeeze plunger during said third and fourth steps;

a fifth step of retracting said squeeze plunger to remove said squeezing pressure from said squeeze passage after the molten metal is solidified in said die cavity; and a sixth step of relatively moving said dies away from one another for the removal of said die-cast product which has been solidified in said die cavity;

wherein said predetermined squeezing pressure is:

(A) greater than the sum of the injection pressure, a sliding frictional resistance generated during the movement of said squeeze plunger and a resistance generated during a shearing deformation of a solidified layer formed at the forward end of the inner peripheral surface of said squeeze passage, but (B) less than the total of said sum and a resistance generated during a shearing deformation of a solidified layer formed in front of said injection plunger.

10. A method as in claim 7 or 9 including the step of retaining said squeeze plunger substantially fully inside said squeeze passage during said third and fourth steps.

11. A method as in claim 1, 2, 3, 5, 6, 7 or 9 wherein said predetermined squeezing pressure is no more than about $$P_{max} = \frac{(r + 2L'\mu)(P_oR^2 + 2(R - \epsilon(t_2)\sqrt{2}\,\epsilon(t_2)(\tau)}{(R - \epsilon(t_2))^2(r)} + \frac{(r + 2L'\mu)\Delta P}{r} + \frac{2\sqrt{2}\,\epsilon(t_2)(\tau)}{r}$$

wherein:

r represents the radius of solid squeeze plunger,

L' represents the length of said squeeze passage that said squeeze plunger remains remote from said die cavity at $t_2$ seconds after the die cavity is filled in said second step and the squeeze plunger has moved from said remote position, $\mu$ represents the coefficient of sliding friction between said squeeze plunger and squeeze passage, $P_o$ represents said predetermined injection pressure, R represents the radius of said injection plunger, $\epsilon(t_2)$ represents the thickness of said solidified layer at the said forward end of said squeeze passage at time $t_2$, $\tau$ represents the magnitude of stress required for shearing said forward end solidified layer in said squeeze passage, and $\Delta P$ represents the squeeze pressure drop caused when said molten metal passes through at least said gate.

12. A method as in claim 11 wherein the squeezing pressure is no more than the defined $P_{max}$ less an amount of about the following pressure drop term:

$$\frac{(r + 2L'\mu)\Delta P}{r}.$$

13. A method as in claim 11 including sensing when said die cavity and squeeze passage are filled during said second step, and immediately starting said squeezing step automatically in response to said sensing.

* * * * *